US009782810B2

(12) United States Patent
Potthoff

(10) Patent No.: US 9,782,810 B2
(45) Date of Patent: Oct. 10, 2017

(54) ROLL STAND CHANGING DEVICE

(71) Applicant: KOCKS Technik GmbH & Co. KG, Hilden (DE)

(72) Inventor: Heinrich Potthoff, Hilden (DE)

(73) Assignee: KOCKS Technik GmbH & Co. KG, Hilden (DE)

( * ) Notice: Subject to any disclaimer, the term of this patent is extended or adjusted under 35 U.S.C. 154(b) by 252 days.

(21) Appl. No.: 14/673,243

(22) Filed: Mar. 30, 2015

(65) Prior Publication Data

US 2015/0290688 A1 Oct. 15, 2015

(30) Foreign Application Priority Data

Apr. 1, 2014 (DE) ..... 10 2014 004 637

(51) Int. Cl.
*B21B 31/08* (2006.01)
*B21B 31/10* (2006.01)
*B21B 13/10* (2006.01)

(52) U.S. Cl.
CPC ..... *B21B 31/08* (2013.01); *B21B 13/10* (2013.01); *B21B 31/103* (2013.01); *B21B 13/103* (2013.01)

(58) Field of Classification Search
CPC ..... B21B 31/08; B21B 31/10; B21B 31/103; B21B 31/14; B21B 39/008; B21B 2203/32; B21B 2203/42; B21B 13/10; B21B 13/103
See application file for complete search history.

(56) References Cited

U.S. PATENT DOCUMENTS 3,323,345 A 6/1967 Lyle et al.
3,418,838 A 12/1968 Rotert et al.
3,433,046 A 3/1969 Remner et al.
3,494,166 A * 2/1970 Severin ..... B21B 17/14 72/239
3,979,939 A 9/1976 Pazderka
3,985,225 A * 10/1976 Baum ..... F27B 9/243 198/834
4,005,594 A * 2/1977 Reth ..... B21B 31/10 72/239
4,070,972 A * 1/1978 Folsom ..... B61B 10/025 104/127
4,274,274 A * 6/1981 Zacharias ..... B21B 31/10 72/239
5,018,926 A * 5/1991 Sternad ..... E04H 6/245 414/232
5,823,036 A * 10/1998 Matsunaga ..... B21D 5/12 72/181

FOREIGN PATENT DOCUMENTS

CA 2398190 A1 7/2001
CN 203143517 U 8/2013
DE 1527706 1/1970
DE 1527659 3/1970
(Continued)

*Primary Examiner* — Edward Toland
(74) *Attorney, Agent, or Firm* — Howard IP Law Group, PC

(57) ABSTRACT

The invention relates to a device for moving a roll stand into or out of a roll stand receptacle of a rolling line, comprising a carrier element for entraining an entrainment element of a roll stand and a conveying element, wherein the carrier element is moved along a predetermined curved path.

22 Claims, 9 Drawing Sheets

(56) References Cited

FOREIGN PATENT DOCUMENTS

| | | | |
|---|---|---|---|
| DE | 2552188 | A1 | 6/1977 |
| DE | 2611703 | A1 | 9/1977 |
| DE | 2721436 | A1 | 11/1978 |
| DE | 21 2008 000 032 | U1 | 1/2010 |
| EP | 1577028 | B1 | 6/2007 |
| GB | 1558428 | | 1/1982 |
| JP | 2002361307 | A | 12/2002 |
| JP | 2008200717 | A | 9/2008 |
| SU | 633828 | A1 | 11/1978 |
| WO | 2008/128417 | A1 | 10/2008 |

* cited by examiner

ROLL STAND CHANGING DEVICE

CROSS REFERENCE TO RELATED APPLICATIONS

This application claims the benefit under 35 U.S.C. §119 (a) or German Patent Application No. 102014004637.0, filed Apr. 1, 2014, the entire disclosure of which is incorporated herein by reference in its entirety for all purposes.

FIELD OF THE INVENTION

This disclosure relates to rolling mills. In particular, this disclosure relates to changing roll stands in a rolling mill.

BACKGROUND OF THE INVENTION

Roll stands having a plurality of rolls, which are designed and disposed such that they form a roll pass for rolling rod-shaped or tubular shaped rolling material, are known in multiple designs. The roll stands are disposed in a roll stand receptacle in a rolling line. Changes in the dimensions of the rolled product or a change of the rolls as a result of damage or wear makes it necessary to change one or a plurality of roll stands and to replace those stands with others.

Previously known roll stand changing devices can essentially be categorized into four types.

In a first group, a roll stand changing cart receives a roll stand, travels with this roll stand (transverse to the direction of rolling) in the rolling line and remains in the rolling line during rolling. The roll stand changing cart and roll stand thereby form a unit. A fixed number of roll stands are thus allocated to a roll stand changing cart. In the case of this group of roll stand changing devices, it is not possible to pull individual roll stands out of the rolling line while the remaining roll stands remain in the rolling line.

In the case of an additional group, the roll stand receptacle of the rolling block is opened at the top and the roll stand can be inserted into the rolling block from above or lifted upward out of this rolling block with the help of a special crane or manipulator. This design is very costly and in addition, the rolling line is generally inaccessible, which is a great disadvantage with regard to serviceability.

According to a third known group, a roll stand is inserted or removed laterally, i.e. transversely to the direction of rolling, in a horizontal direction from the roll stand changing cart down into in what is referred to as the roll stand receptacle of the rolling block. A separate displacement mechanism may be provided for each roll stand so that, depending on the operator's wishes, either individual roll stands or all of the roll stands together can be displaced from the rolling block onto the roll stand changing cart or from the roll stand changing cart into the rolling block. The known displacement mechanism is disposed either on the side of the roll stand that is facing away from the operating side, or in other words the so-called drive side, or on the operating side. The configuration of the displacement mechanisms on the drive side has the disadvantage that the available installation space is extremely limited due to other components that are disposed here, as a result of which the displacement path that must be achieved is very small. In addition, any maintenance work that is needed is costly and inconvenient to perform. Insofar as the displacement mechanism is disposed on the operating side, two different designs are known. On the one hand, the displacement mechanisms may be disposed on the operating side of the rolling block, on the other side of the roll stand changing cart. The roll stand changing cart is thus located between the rolling block and the displacement mechanism. Inevitably, the result is that the roll stand changing cart can only travel parallel to the rolling line, but not transverse to the rolling line away from the rolling block directly into the roll stand workshop. This can lead to serious disadvantages, which are dependent on the existing layout of the respective roll train. Among other things, it may be provided that the displacement mechanisms are disposed on the roll stand changing cart itself. In this case, this results in the disadvantage that at least twice the number of the roll stand displacement mechanisms must be provided, since there are always at least two roll stand changing carts present.

As an alternative to the option of providing a separate displacement mechanism for each roll stand, it is also possible to move the roll stands of the rolling block with the help of a so-called changing beam, which extends along the length of the rolling block. The result of this is that, for technical reasons, it is not possible to dispose the changing beam on the drive side, since, as a result, the roll stands cannot be moved individually, but rather, can only be moved collectively on the rolling block.

In the case that the changing beam is disposed on the operating side of the roll stand, a distinction can be made between three designs. In the case of the first design, the changing beam and the drive thereof are disposed on the operating side, on the other side of the changing beam. The result is the already known disadvantage that the roll stand changing cart cannot travel directly with the roll stands (transverse to the rolling line) into the roll stand workshop. In a second design, the changing beam and the drive therefor are disposed on the roll stand changing cart. This design has the disadvantage that two roll stand displacement units must be provided, since at least two roll stand changing carts are needed in order to quickly exchange a roll stand. In a third design, the changing beam is disposed on the roll stand changing cart, while the displacement drive, on the other hand, is displaced on the side of the rolling block. This design has the advantage that only the changing beam must be implemented twice, however the associated drive need only be implemented once. In the case of the latter design, the roll stand changing carts can travel directly, transversely to the rolling line, into the roll stand workshop. The disadvantage, however, is that the displacement unit must make a number of empty trips in order to connect to the changing beam located on the roll stand changing cart before displacing the roll stand, and in order to disconnect from the changing beam and return to the starting position after the displacement of the roll stand. Furthermore, the required coupling mechanism results in a cost disadvantage.

In the fourth group of roll stand changing devices, the devices are moved out of the rolling block, either in the direction of rolling or against the direction of rolling.

The primary disadvantage of this so-called tunnel solution is that a displaceable roller table must be disposed either in front of or behind the rolling block, in order to create the space to move the device out of the rolling block. Under circumstances, this results in serious disadvantages for the layout of the entire roll train. A special design of this roll frame changing system provides that half of the stand travels out of the block in the direction of rolling, and the other half travels out of the block against the direction of rolling. This increases the technical complexity however, without reducing the overall space requirements.

The changing mechanisms used in the prior art use a displacement element that can be moved in a straight line, which element can be actuated such that it engages with the roll stand, and which must be again disconnected or, respectively, removed therefrom. Purely translational movements are carried out, which must be carried out twice in order to displace the roll stand out of the roll stand receptacle, for example when using the changing beam: one movement for the extension and one movement for a disengagement therefrom.

SUMMARY

The object of the invention is to create a device and a method for moving a roll stand into or out of a roll stand receptacle of a rolling line, as well as a system for moving a roll stand into or out of a roll stand receptacle of a rolling line, which functions reliably and which makes it possible to change the roll stands individually in a short amount of time. The ability to change roll stands individually or collectively (simultaneously) is desirable. In addition, the ability to move the roll stand changing carts both parallel to the rolling line, and also (insofar as desired) directly, i.e. out from the rolling block, transverse to the rolling line, into the roll stand workshop, is desirable.

DETAILED DESCRIPTION

Figure 1:
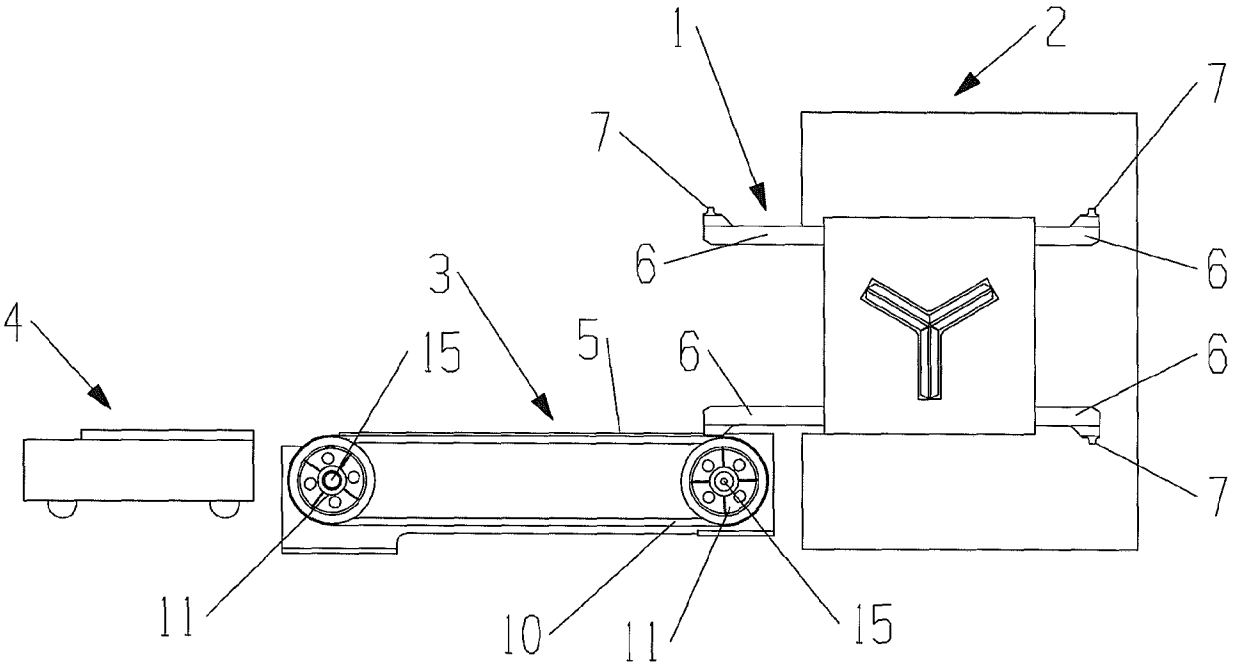
FIG. 1 illustrates a roll stand in a roll stand receptacle, a roll stand changing cart and a device according to the invention, in a schematic side view, transverse to the rolling line.

The core idea of the invention is to provide at least one carrier element, which is moved along a predetermined curved path by means of a conveying element. The curved path has at least one non-linear (non-translational) section, along which the carrier element is moved along a curve, and thus, not along a linear path.

The carrier element performs a predetermined movement that is imparted thereto by the conveying element, which movement makes it possible to quickly connect to and disconnect from the entrainment element of the roll stand, for example. In particular, the movement of the carrier element along the curved path may be configured in such a way that it includes a reciprocating motion transverse to the rolling line, and is combined with a movement along a curve, for example with a lowering and/or raising movement. The reciprocating motion may be a pure translational movement, which may be followed by the curved movement, for example a lowering and/or raising movement. It is particularly preferred that the movement along the curved path contain a first translational movement, followed by a subsequent movement along a curve, followed by a subsequent translational movement, and followed by a subsequent additional movement along a curve. It is particularly preferred that the second translational movement be the reverse of the first translational movement.

What is achieved is that, once a roll stand has been placed on the roll stand changing cart, said cart can be moved away, either transverse to the rolling line, or also along, i.e. parallel to, the rolling line, without it being necessary to disconnect a displacement mechanism from the roll stand. Coupling and/or decoupling may be done automatically by means of the imparted, predetermined movement along a curved path by a carrier element. The entrainment means does not need to be backed away in the same direction. Both time and costs can be saved.

In a preferred embodiment, the curved path lies in a plane that is perpendicular to the rolling line. As a result, it is possible for the carrier element to make a movement that is aligned perpendicular to the rolling line. This then creates the possibility of pulling an entrainment element of a roll stand out of the roll stand receptacle in a direction that is perpendicular to the rolling line or to push said roll stand into a roll stand receptacle using the carrier element, wherein, at the same time, the device according to the invention can have a very slender design in the direction of the rolling line. Embodiments are also possible in which the curved path lies completely in a plane that is perpendicular to the rolling line. Embodiments are also possible, however, in which only sections of the curved path lie in a plane that is perpendicular to the rolling line, and in which sections of said path lead out of this plane. This allows the carrier element to impart a multi-dimensional movement on the entrainment elements, for example in the event that, after being withdrawn from the rolling line, a roll stand must still be laterally offset (thus in the direction of the rolling line) before it is pushed onto the roll stand changing cart.

In an alternative embodiment, the curved path lies in a plane that contains the rolling line or that extends parallel to the rolling line. The result is that it is possible for the carrier element to carry out a horizontal movement that is aligned perpendicular to the rolling line, for example, while at the same time, however, the device according to the invention can have a very slender design in the vertical direction. This creates the possibility of pulling an entrainment element of a roll stand out of the roll stand receptacle in a direction that is perpendicular to the rolling line, or of pushing said element into a roll stand receptacle using the carrier element. Embodiments are also possible in which the curved path lies entirely in a plane that contains the rolling line that extends parallel to the rolling line. Embodiments are also possible, however, in which only sections of the curved path lie in a plane, which contains the rolling line or which extends parallel to the rolling line, and in which sections of said path lead out of this plane. In this way, the carrier element can impart a multi-dimensional movement on the entrainment elements, for example in the event that a roll stand is to be lowered or raised after being pulled out of the rolling line, before it is pushed onto the roll stand changing cart. Likewise, the curved path may extend in a plane, which is at an angle from the rolling line other than a 90° angle.

The carrier element is suitable for entraining an entrainment element of a roll stand. The carrier element may have the shape of a protruding element, for example a mandrel, pin or hook, in order that it can engage with a recess in an entrainment element, for example a ring on a roll stand, or can interact with a projection on a roll stand. It is particularly preferred, however, that the carrier element have a recess, with which a protruding element, for example a pin, mandrel or hook of an entrainment element of a roll stand can engage, or that said element have a projection, with which a projection of the roll stand can interact. A carrier element that is equipped with a recess can have a flatter design than an element having a protruding element, for example a carrier element that is designed as a mandrel or a pin. A carrier element having a flat design is particularly preferred when the carrier element is to be returned without having contact with the entrainment element within the device according to the invention. The free space that must be provided for the return of said element is reduced by the flat design.

The carrier element can thus be designed such that it can interact with an entrainment element of a roll stand in only one direction. For example, the carrier element may have a projection, which has a contact surface that faces in one direction. This contact surface can interact with a contact surface of a projection of an entrainment element of a roll stand, and can entrain this element in a direction of movement. In this embodiment, if the carrier element moves in another direction, the contact between the contact surfaces is lost, and the carrier element does not entrain the entrainment element. In an embodiment of this kind, depending on the configuration, the one carrier element may either be used to pull a roll stand out of the roll stand receptacle, or may be used to push a roll stand into the roll stand receptacle. A further carrier element is preferably provided for the opposite movement.

In a particularly preferred embodiment, the carrier element is designed such that it can interact with an entrainment element of a roll stand in two directions of movement and in a particularly preferred manner, in two opposing directions of movement. In an embodiment of this kind, the one carrier element may either be used both to pull a roll stand out of the roll stand receptacle, and to push a roll stand into the roll stand receptacle. To this end, it is particularly preferred that the carrier element have two projections, on which are formed contact surfaces for contact with an entrainment element of a roll stand, wherein the normal vectors of the contact surfaces are at an angle to one another, in particular at an angle of 180° (the contact surfaces are thus facing one another). It is particularly preferred that the contact surfaces form boundary surfaces of a recess. It is particularly preferred that the recess be designed such that it is essentially U-shaped.

There are preferably at least two carrier elements present, which are spaced apart from one another in the direction of the rolling line. A configuration of this kind makes it possible that, parallel to two entrainment elements of the roll stand, a movement can be imparted to the roll stand. In this way, it is possible to achieve a linear movement of the roll stand by imparting the movement via two spaced points, to which end the two carrier elements are preferably synchronized with one another. The carrier elements can preferably move parallel to one another while maintaining the spacing therebetween.

In one embodiment, in which the device has a sliding surface, along which a roll stand having the device according to the invention slides, it is particularly preferred when a carrier element is provided on each side of the sliding surface. In so doing, the carrier elements can be moved beneath the sliding surface on a curved path. The sliding surface does not necessarily have to form a closed surface, but instead, the term also includes (a plurality of not necessarily contiguous) sliding rails, on which the roll stand can be displaced.

In a preferred embodiment, there are two carrier elements present, which, in a particularly preferred manner, are spaced apart from one another in a direction that is transverse to the rolling line, which carrier elements can be moved along the same curved path. Each of the carrier elements may be brought into contact with a corresponding entrainment element of the roll stand. Likewise, a carrier element may be designed to be used for the entrainment of an entrainment element in a first direction of movement, for example when pulling a roll stand out of the roll stand receptacle, while the other carrier element may be designed to be used or the entrainment of the entrainment element in a second, opposite direction of movement, for example when pushing a roll stand into the roll stand receptacle.

A "conveying element" is understood, in particular, to be an element of a drive, which, in order to move the roll stand, can impart a force to the roll stand via the carrier element, in particular a force that is exerted transverse to the rolling line in order to move roll stand.

The conveying element does not necessarily have to be designed to accommodate or, respectively, to bear the mass or, respectively, the weight of the roll stand; for example, a carrier element can move the roll stand by sliding it on a sliding surface via the contact with the entrainment element, which does not need to be part of the conveying element. In particular the weight or, respectively, the mass of the roll stand may essentially rest on the sliding surface and not on the carrier element, or, respectively, the conveying element. A conveying element may be designed as a traction mechanism, which has a carrier element. The carrier element may be part of the conveying element or may be affixed thereto. The conveying element or, respectively, traction mechanism may be designed so that it can be at least partly rotated by means of a drive. The drive may be designed such that it can pull or push a conveying element, which is designed as a traction element, in one direction. As a result, the carrier element can be moved in one direction along the curved path. In addition, the drive may be designed such that it can pull or push a conveying element, which is designed as a traction element, in the opposite direction. As a result, the carrier element can be moved in the opposite direction along the curved path.

The conveying element is preferably a cord, a chain, a push chain or a belt. This allows for a simple design.

In a preferred embodiment, the conveying element is designed such that it revolves. In this way, a closed curved path can be achieved, along which the carrier element can revolve. In particular when the conveying element is designed as a cord, a chain or a belt, in the case of a revolving conveying element, the opportunity is provided for a simple drive for the conveying element, for example via a drive roll, or, respectively, a drive pinion, which is partially encircled by the conveying element. In the case that a cord, a belt or a chain are used, however, it is also conceivable that a roll is provided at each of the opposite ends thereof and the cord, the belt or, respectively, the chain is wound on the one roll for a movement of the carrier element that is connected to the conveying element, and is wound on the opposite roll for the movement in the opposite direction.

In a preferred embodiment, the axis of rotation of the drive roll or, respectively, of the drive pinion is horizontally aligned. This design is particularly suitable for forming a curved path, which lies in a plane that is perpendicular to the rolling line.

There are preferably two conveying elements present, and it is particularly preferable that there be two conveying elements present, which can revolve. A common drive for the two conveying elements may be present, or each of the two conveying elements may be driven separately. In the case of a common drive, the conveying element may be guided about a common shaft, whereby the two conveying elements can be synchronized with one another. In the case of different drives, a common shaft, which extends between the conveying elements in the direction of the rolling line, can be omitted and a more compact design may be selected for each of the conveying elements, since a connection via a common shaft can be omitted.

In a preferred embodiment, the chain is an endless link chain, by which means a robust, revolving conveying element that is less prone to wear can be formed. In addition, a known type of drive for an endless link chain may be selected, for example at least one, in particular vertically disposed, chain sprocket. The chain sprocket or, respectively, chain sprockets, do not necessarily have to be vertically disposed, however it is advantageous when the chain sprockets are at an angle from the horizontal that is not equal to 0°, and preferably an angle that is close to or equal to 90° is selected. In a preferred embodiment, two link chains are provided, which are spaced apart from one another in the direction of rolling, on each of which chains at least one carrier element is present. The two link chains can each revolve about two chain sprockets, wherein at least one or both of the chain sprockets can be driven. Each of the two chain sprockets for a chain is driven by a drive, and preferably the two driven chain sprockets are disposed on a common shaft, which makes it possible to synchronize the carrier elements provided on the two link chains.

In a preferred embodiment, the carrier element has the dimensions of a chain link in a link chain or a multiple thereof, preferably an uneven multiple of the chain link, which makes a simple design of the drive by means of a vertically disposed chain sprocket possible.

The carrier element may be rigidly or pivotably connected to the conveying element.

The carrier element may have a multi-part design and in particular, a, two-part design. For example, a part of the carrier element may provide a contact surface, which is suitable for entraining an entrainment element of the roll stand in one direction of movement, while a second part of the carrier element may provide a contact surface, which is suitable for the entrainment of the entrainment element of the roll stand in a second direction of movement, in particular in the opposite direction of movement. It is particularly preferred that the second part be movable relative to the first part, and in particular, it is preferred that it have a swiveling design. As a result, the object can be achieved that when the carrier element is moved, the second part can be pivoted in one direction, and an entrainment element that is engaged with the first part is not blocked.

The system according to the invention comprises a device according to the invention and a roll stand having an entrainment element, which can be entrained by a carrier element in order to move the roll stand into or out of a roll stand receptacle of a rolling line. The system according to the invention may be composed of a rolling block having one or a plurality of roll stands, which are held in roll stand receptacles in order to form a rolling line as well as having drives provided on a drive side in order to drive the rolls of the roll stands, and of a device according to the invention. It is particularly preferred that a roll stand changing cart form a part of the system according to the invention.

In a preferred embodiment, the roll stand has an entrainment element on the drive side and/or on the operating side, which lies opposite the drive side. It is particularly preferred that the entrainment element be a protruding element, in particular, a mandrel, pin or hook.

In a preferred embodiment, the device according to the invention, which is used as part of the system, has a sliding surface or sliding rails that are disposed parallel to one another, which, with the device according to the invention, are disposed between a roll stand changing cart and the respective roll stand receptacle. The sliding surfaces may be used to accommodate the weight force of the roll stand that is to be moved from the roll stand location to the roll stand changing cart or vice versa. As a result, the load on the conveying element, which moves the carrier element, can be relieved, since this conveying element no longer needs to accommodate the weight force of the roll stand.

In a preferred embodiment, the device according to the invention is designed having two carrier elements, which are moved along the same curved path, and the roll stand is designed having two entrainment elements, preferably one on the operating side and one on the drive side. In an embodiment of this kind, the spacing between the carrier elements is preferably such that the entrainment elements (operating and drive side), which interact with the carrier element, are not constantly simultaneously in contact with both carrier elements. The spacing of the carrier elements is thereby preferably essentially the same as the spacing of the entrainment elements between the drive and operating side of the roll stand. For example, when pulling the roll stand out of the roll stand receptacle, a first carrier element engages with the operating side of the entrainment element of the roll stand, and the roll stand can be pulled out of the roll stand receptacle onto the sliding surface ("bridge before the block"). The second carrier element can be actuated thereby, such that it engages with the second (operating side) entrainment element, wherein the roll stand can now be pulled by the carrier element and pushed by the carrier element for a short time. The first carrier element can then be disengaged from the first (operating side) entrainment element, and pushed by the second carrier element. An automated pulling onto the sliding surface and pushing from the sliding surface is made possible thereby by said selection of the spacing.

In a preferred embodiment, the roll stand has three or four rolls, which are disposed in a star-shape about the roll pass in order to form a roll pass for rolling rod-shaped or tubular-shaped material.

In a preferred embodiment, the carrier element is guided along a curved path, which then partially also extends below the roll stand. As a result, the carrier element can be guided well to an entrainment element of the roll stand.

In a preferred embodiment, the entrainment element protrudes beyond the base body of the roll stand, which contains the essential parts of the roll stand. As a result, the object can be achieved that the base body of the roll stand can be pushed by the device according to the invention completely onto a roll stand changing cart without having to partially run the curved path beneath the roll stand changing cart.

It may be provided that the carrier mechanism essentially extends along the entire displacement path of a roll stand. In particular, the guide wheels on the drive side can then be located behind the trailing edge of a roll stand, which is located in the rolling position in the roll stand receptacle. In this embodiment, the roll stand may have only one entrainment element, which can be disposed on the drive side. In this embodiment, it is possible to omit the entrainment elements on the operating side. Two entrainment elements that are spaced apart from one another in the direction of the rolling line may preferably be provided so that there are two entrainment elements per roll stand. As a result, it is possible to allow the resulting displacement force to be exerted in the center plane of the frame without, however, taking up installation space in the region of the center plane of the frame for the conveying elements. This is especially advantageous when one of the frame couplers, which serve as a drive for the roll shafts, is disposed in the region of the roll stand displacement mechanism. As a result, the roll stand can have a more compact design and can be handled more easily in the stand workshop.

The contact surface for moving the roll stand inward may remain in contact with the entrainment element of the roll stand during the rolling in order to prevent the roll stand from creeping out of the roll stand receptacle. Insofar as the contact surface used for sliding the roll stand out of the roll stand receptacle can be moved to a certain extent in a straight line above the center line of the guide wheels on the operating side, it is possible to push a roll stand further onto the roll stand changing cart and thereby, to design an extension arm for an entrainment element on the roll stand to be as short as possible. In the specified embodiment, this can be achieved in that the contact surface for moving the roll stand inward into the roll stand receptacle is lowered shortly before said surface reaches its end position when extended.

The method according to the invention for moving a roll stand into or out of a roll stand receptacle of a rolling line provides that a carrier element is brought into contact with an entrainment element of the roll stand, and that the carrier element is moved such that it follows a predetermined curved path.

FIG. 1 shows a rolling mill from the feed end. A roll stand 1 is disposed in a roll stand receptacle 2. A device 3 is positioned between the roll stand receptacle 2 and a roll stand changing cart 4 in order to move the roll stand 1. The device 3 is disposed below sliding rails 5, on which the roll stand 1 can be displaced.

The roll stand 1 has an extension arm 6 both on the drive side, i.e., on the right in the depiction shown, and on the operating side, i.e., on the left in the depiction shown, wherein an entrainment element 7 having a hook-shape is disposed at the end of each extension arm 6.

The device 3, in turn, has a carrier element 8 (shown in FIG. 2) having a contact surface, which can be brought into contact with the entrainment element 7. The carrier element 8 is disposed on a conveying element 10 or, respectively, on a part thereof. There are two conveying elements 10 having at least one carrier element 8 present, which are designed as two revolving traction mechanisms in the form of link chains. A conveying element 10 revolves about the two guide wheels 11. The traction mechanism or, respectively, the conveying elements 10 are disposed one behind the other in the direction normal to the paper plane. The guide wheels 11, which are located one behind the other, are disposed on a shaft 15.

Figure 2:
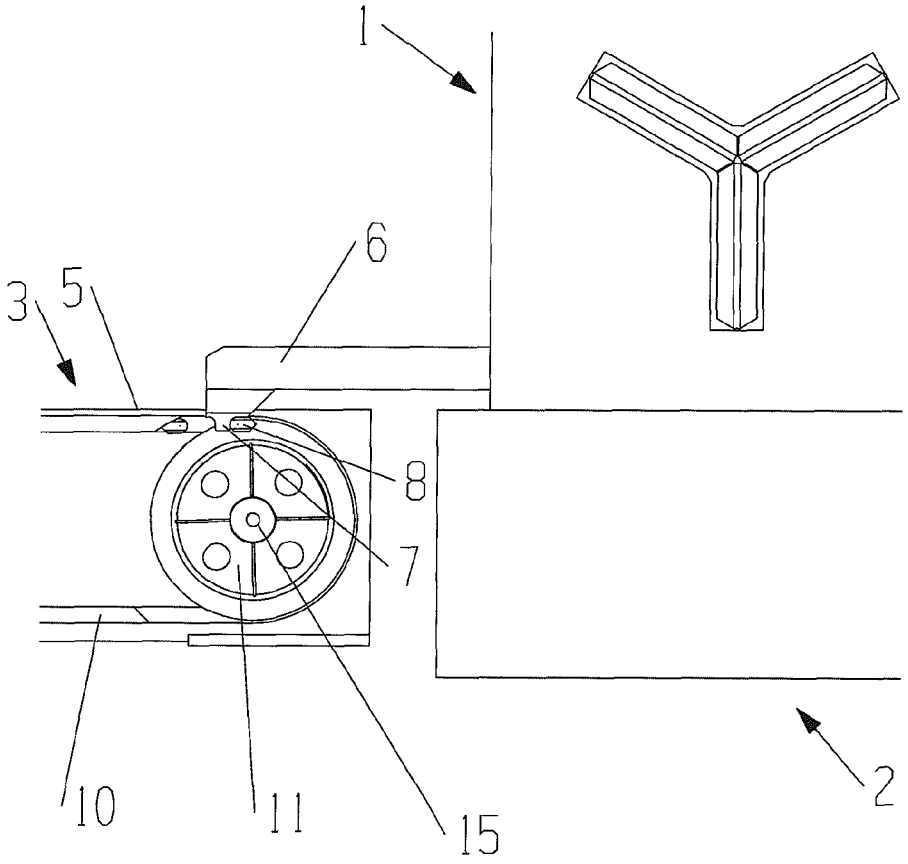
FIG. 2 shows a detail from FIG. 1.

When pulling the roll stand 1 out of the roll stand receptacle 2, a first carrier element 8 engages with the entrainment element 7 on the operating side of the roll stand 1 (see FIG. 2). The roll stand 1 is pulled out of the roll stand receptacle 2 onto the sliding surface 5 ("bridge before the block"). The sliding surface 5 may have a plurality of sliding rails. The sliding surface 5, together with the device 3, can form a displaceable unit.

Figure 3:
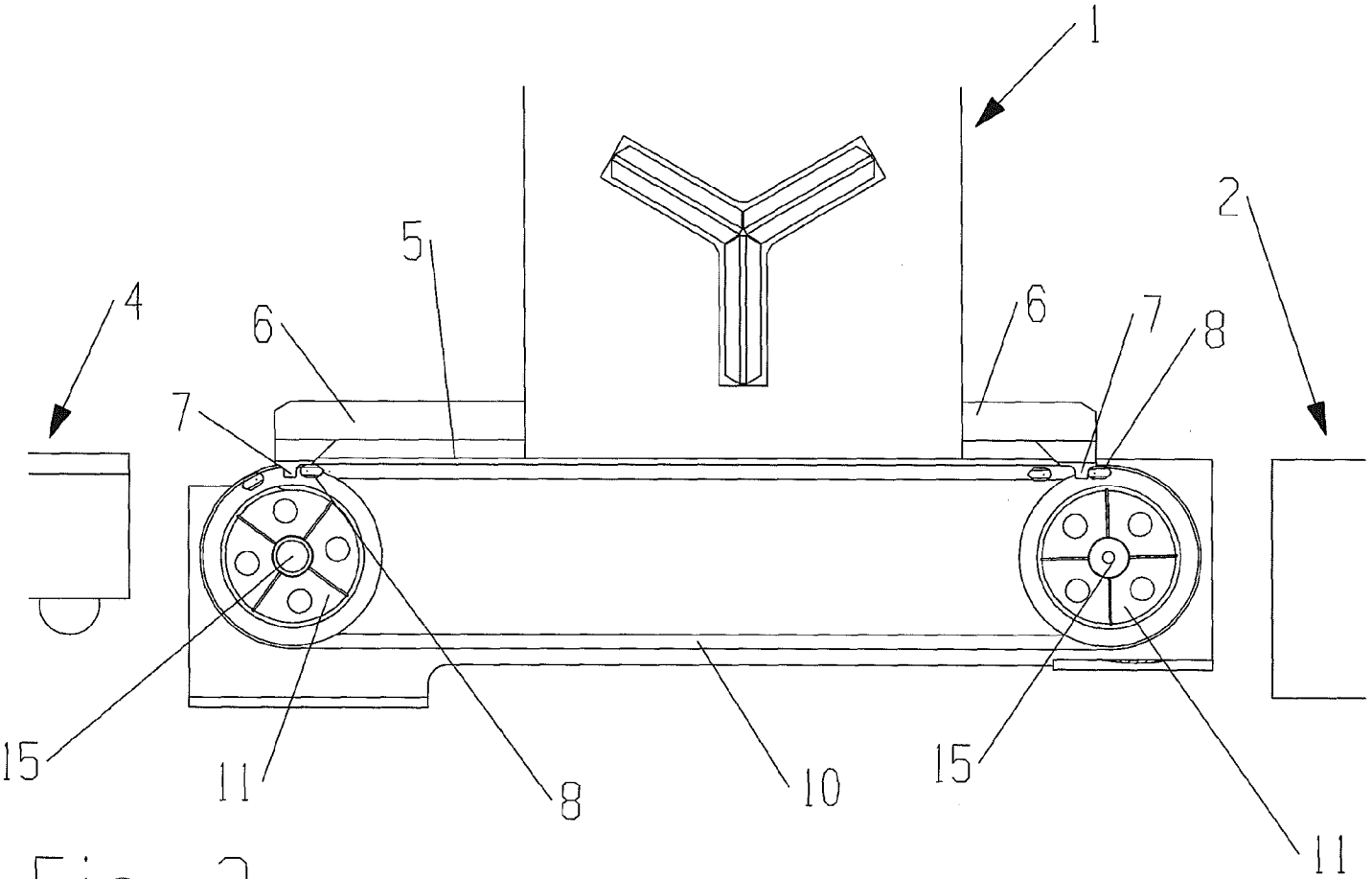
FIG. 3 is a schematic side view of the device according to the invention of FIG. 1 during the displacement of the roll stand.

FIG. 3 shows how the roll stand 1 rests completely on the sliding surface 5. In this state, two entrainment elements 7 are in contact with two carrier elements 8. As a result of the further revolving of the traction mechanism 10, and thus of the carrier elements 8, the left carrier element 8 is actuated such that it no longer engages with the entrainment element 7 in that the carrier element 8 is lowered following the guide wheel 11 when the roll stand 1 is pushed by the carrier element 8, which is shown on the right in FIG. 3, as far as the roll stand changing cart 4. The carrier element 8, which is shown on the right in FIG. 3, also becomes disengaged from the entrainment element 7, by means of the guide wheel 11, when the roll stand 1 rests on the roll stand changing cart 4.

Figure 4:
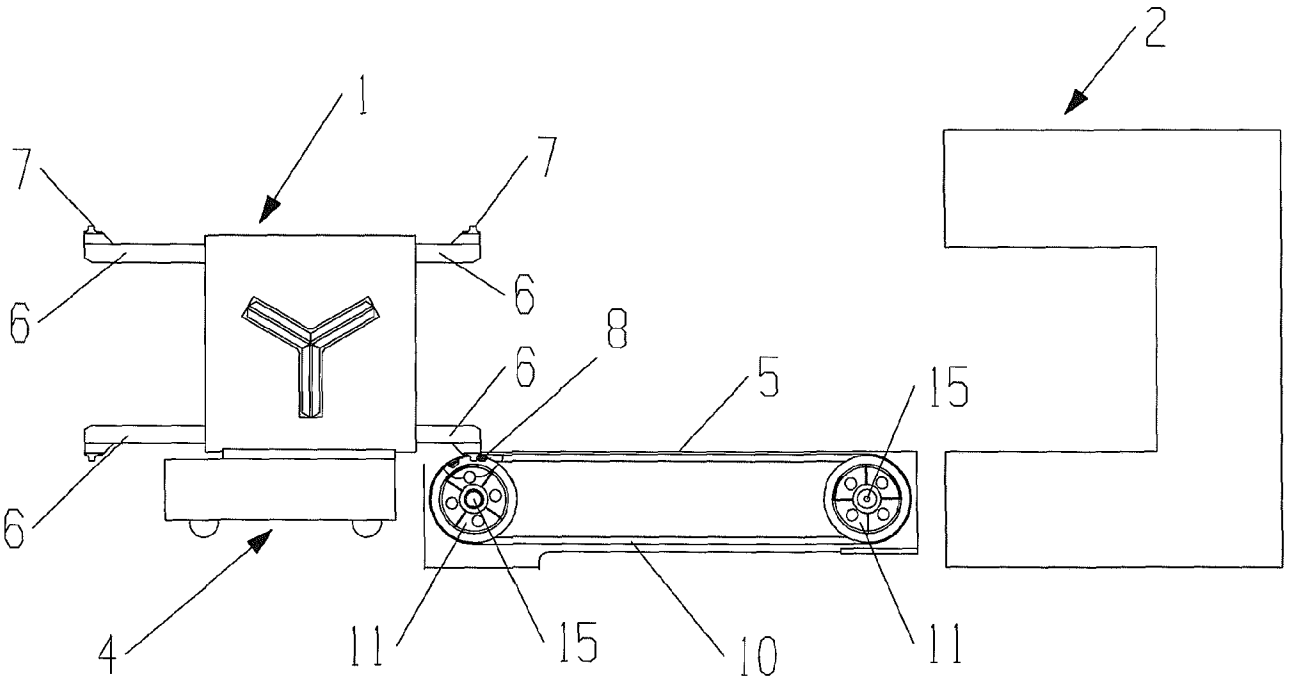
FIG. 4 is a schematic side view of the device according to the invention of FIG. 1 when the roll stand is pushed onto the roll stand changing cart.

FIG. 4 shows the status shortly before the carrier element 8 becomes disengaged from the entrainment element 7.

Figure 5:
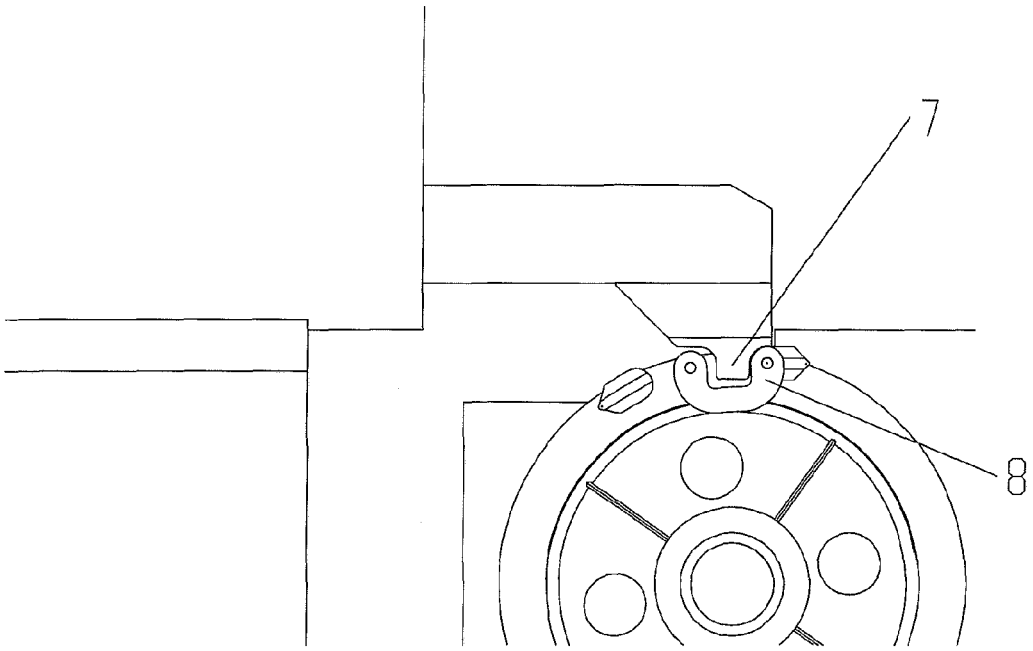
FIG. 5 shows a detail from FIG. 4.

FIG. 5 shows a detail from FIG. 4. FIG. 5 shows an enlarged depiction of the carrier element 8 and the entrainment element 7. It can be seen that the entrainment element 7 disposed on the drive side of the roll stand 1 is designed such that the contact surface, which serves to push the roll stand 1 out, is disposed externally on the entrainment element 7 on an extension arm 6. Accordingly, a correspondingly shaped carrier element 8, having a corresponding contact surface, is provided on the device 3. In the embodiment depicted in FIGS. 1 through 5, the carrier element 8 has a recess, which is essentially U-shaped. Insofar as the traction mechanism 10 is designed as a chain, the carrier element 8 replaces a single chain link or an uneven multiple thereof.

The process of sliding a roll stand 1 out of the roll stand receptacle 2 onto a roll stand changing cart 4, which is shown in FIGS. 1 through 4, can also be reversed using the device 3. The device 3 serves to insert the roll stand 1 into the roll stand receptacle 2 from the roll stand changing cart 4.

The device 3 is positioned between the roll stand changing cart 4 and the roll stand receptacle 2. As a result of the rotation of the traction mechanism 10 about the guide wheels 11, a carrier element 8 comes to rest against at least one contact surface or, respectively, engages with an entrainment element 7, and this occurs when the carrier element 8 rises along the curved path provided by the guide wheel 11. The roll stand 1 is pulled in the direction of the rolling line from the roll stand changing cart 4 down onto the sliding surface 5. As soon as the roll stand 1 is completely located on the operating side, i.e., having the entrainment element 7 of said roll stand located on the sliding surface 5, a further carrier element 8, which is disposed on the traction element 10, comes into contact with the entrainment element 7 disposed on the operating side of the roll stand 1 (again, automatically as a result of the curved path, which is created by the revolution of the traction mechanism 10 or, respectively, of the carrier element 8 about the guide wheels 11). The roll stand 1 is now pushed further in the direction of the roll stand receptacle 2 by the revolving traction mechanism 10 and the carrier elements 8 disposed thereon. When the entrainment element 7 on the drive side of the roll stand 1 leaves the sliding surface 5, (as a result of the curved path, implemented by the revolution of the carrier elements 8 about the guide wheel 11) the entrainment element 7, which is disposed on the traction mechanism 10, again becomes disengaged from the carrier element 8, due to the fact that the carrier element 8 has been lowered. As the traction mechanism 10 continues to revolve, the roll stand 1 is pushed solely by the further (left) carrier element 8, which is in contact with the entrainment element 7 on the operating side, until said stand has reached its position on the roll stand receptacle 2 (see FIG. 1).

Figure 6:
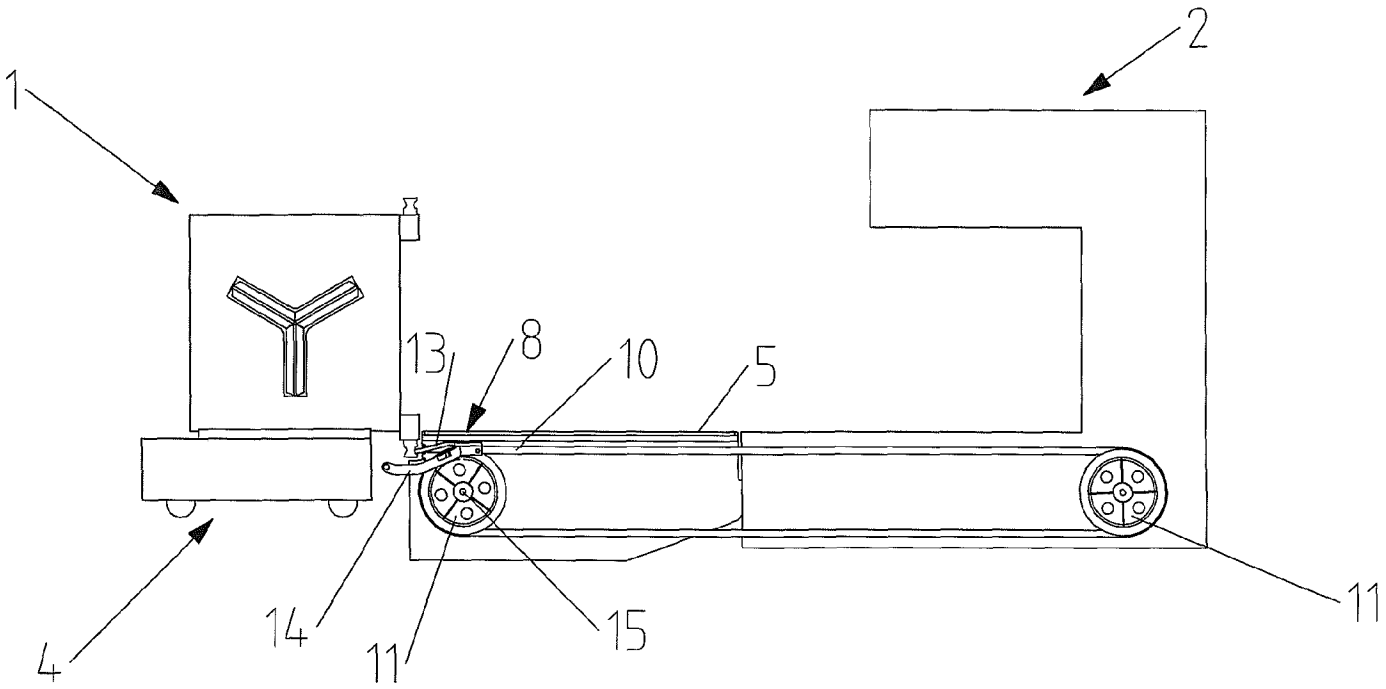
FIG. 6 is a schematic side view of a further embodiment of the device according to the invention having a roll stand changing cart, roll stand and roll stand receptacle.
Figure 7:
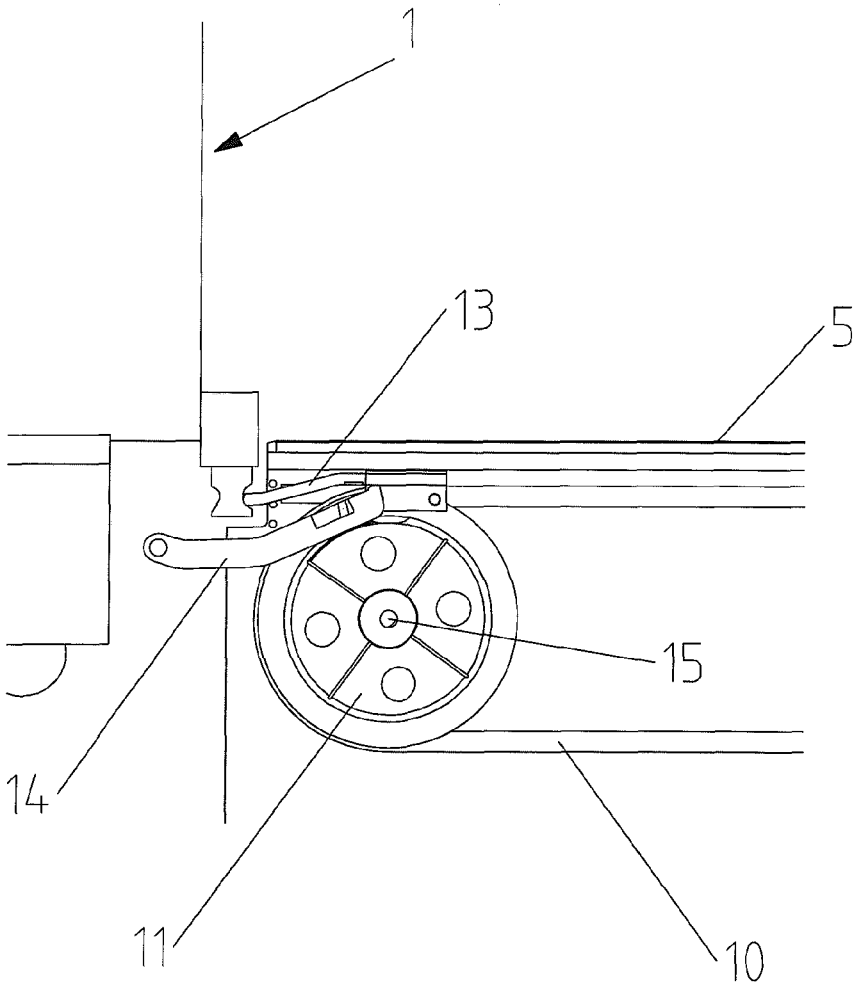
FIG. 7 shows a detail from FIG. 6.
Figure 8:
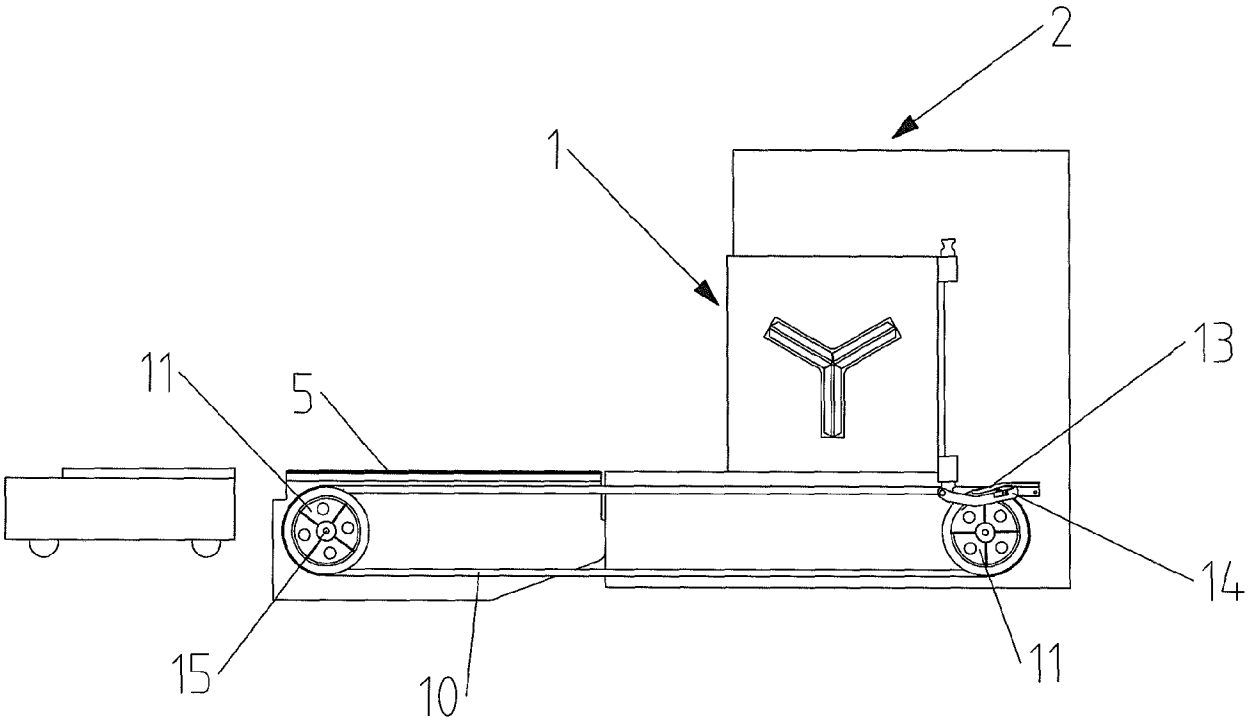
FIG. 8 is a schematic side view of the embodiment according to FIG. 6 having a roll stand inserted into the roll stand receptacle and FIG. 9 is a schematic top view of a roll stand changing cart.

In the embodiment depicted in FIGS. 6 through 8, the traction mechanism 10 of a carrier mechanism 9 extends over the entire displacement region of the roll stand 1. The guide wheels 11 on the operating side are still located behind the trailing edge of the roll stand 1, which is in a rolling position (see FIG. 6). In the embodiment shown in FIGS. 6 through 8, the roll stand 1 has only one entrainment element 7 for the carrier elements 8 on the drive side.

The embodiment of the carrier element 8 shown in FIGS. 6 through 8, which is described in greater detail below, may also be used in the embodiments shown in FIGS. 1 through 5, which were described above. The carrier element 8 in FIGS. 6 through 8 is at least partially pivotable with respect to the conveying element 10. To this end, the carrier element 8 according to FIGS. 6 through 8 has a multi-part design. The carrier element 8 comprises part 13 and part 14. The part 13 of the carrier element 8 serves to push the roll stand 1 out of the roll stand receptacle 2 and can be moved to a certain extent above the center plane of the guide wheel on the operating side 11. As a result, the extension arm 6, on which the entrainment element 7 is disposed, can be kept as short as possible. In order to ensure that the roll stand changing cart 4 is able to move away with the roll stand 1, transverse to the rolling line, the part 14 of the carrier element 8, which serves to move the roll stand 1 inward, is lowered shortly before reaching the end position when the roll stand 1 is moved inward onto the sliding surface 5.

FIG. 7 depicts how the pivoting or, respectively, lowering of the contact surface of the carrier element 8 is implemented. The first part 13 is directly connected to the traction mechanism or, respectively, the conveying element 10 and in addition, is guided linearly. The second part 14 is pivotably mounted on a bolt, which bolt is then connected to the conveying element 10. In addition, the second part 14 is supported via a spherical contact surface on the first part 13.

FIG. 8 shows how the roll stand 1 is inserted into the roll stand receptacle. The effective surface of the second part 14 is in contact with the entrainment element 7 of the roll stand 1 and can prevent the roll stand 1 from creeping out of the roll stand receptacle 2 during the rolling operation.

Figure 9:
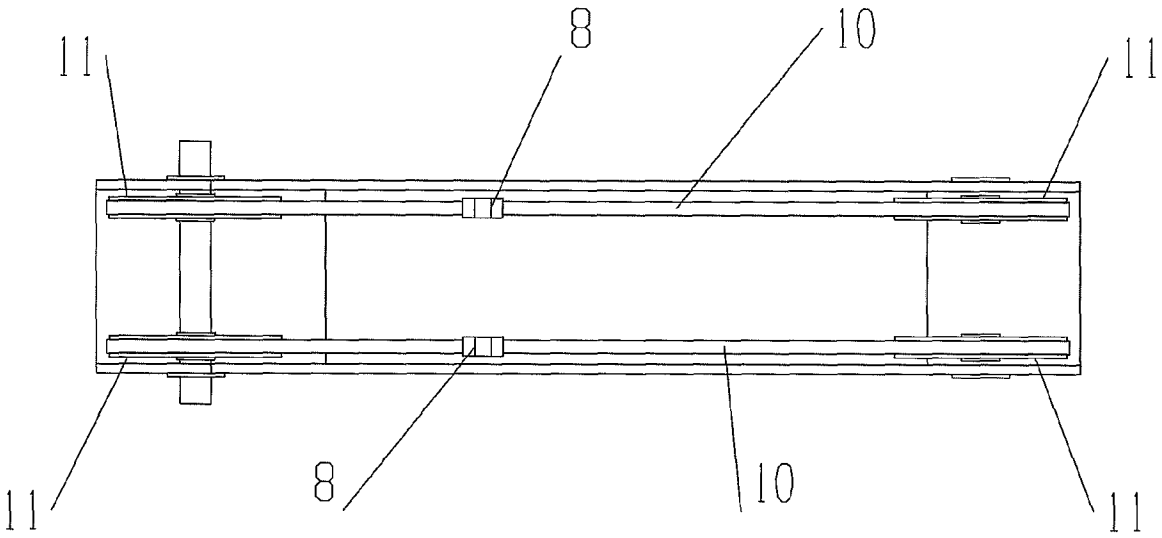

FIG. 9 shows that the roll stand changing cart may have two carrier elements 8, which are spaced apart from one another in a direction that is transverse to the direction of movement thereof, which carrier elements are each disposed on a revolving conveying element 10. The two conveying elements 10, which are disposed in parallel, revolve about guide wheels 11. By using these two conveying elements 10, which revolve parallel to one another, with carrier elements 8, it is possible for the resulting displacement force to be exerted in the center plane of the roll stand changing cart and to be exerted, with a corresponding configuration of the roll stand changing cart relative to the roll stand, in the center plane of the roll stand, without requiring installation space for a conveying element in the region of the center plane.

The invention claimed is:

1. A device for moving a roll stand into or out of a roll stand receptacle of a rolling line, comprising:

a first carrier element configured to entrain an entrainment element of said roll stand when said roll stand is in the roll stand receptacle of the rolling line and when said roll stand is on a roll stand changing cart; and a conveying element including a first end adjacent to the roll stand receptacle and a second end adjacent to the roll stand changing cart, wherein said conveying element is configured to move said first carrier element along a predetermined curved path to cause (i) said roll stand to move from said roll stand receptacle to said roll stand changing cart, and (ii) said roll stand to move from said roll stand changing cart to said roll stand receptacle.

2. The device of claim 1, wherein said predetermined curved path lies in one of: a plane perpendicular to said rolling line, a plane parallel to said rolling line, and a plane containing said rolling line.

3. The device of claim 1 further comprising:

a second carrier element, said first and second carrier elements spaced apart from one another in a direction transverse to a direction of movement of said first and second carrier elements.

4. The device of claim 1, comprising:

a second carrier element, wherein each of said first and second carrier elements are configured to travel along the predetermined curved path.

5. The device of claim 1, wherein said conveying element is configured to revolve.

6. The device of claim 1, said conveying element comprising:

two revolving conveying elements, wherein a first revolving conveying element of said two revolving conveying elements is disposed parallel to a second revolving conveying element of said two revolving conveying elements.

7. The device of claim 1, wherein said conveying element is configured as one of: a cord, a chain and a belt.

8. The device of claim 1, wherein said carrier element comprises multiple parts.

9. The device of claim 1, wherein said carrier element is configured to define an essentially U-shaped recess.

10. The device of claim 1, wherein said carrier element is pivotably connected to said conveying element.

11. The device of claim 1, said conveying element comprising:

a traction mechanism connected to a first part of said carrier element; and pivotally connecting a second part of said carrier element to the traction mechanism, wherein said second part of the carrier element is supported by a spherical contact surface of the first part of the carrier element.

12. The device of claim 1, further comprising:

a drive connected to said conveying element, wherein said drive is configured to rotate said conveying element along a path, said carrier element on the conveying element adapted to follow said path, said path including a reciprocating translating motion transverse to the rolling line, a motion along a first curve to provide a raising movement of the carrier element, and a motion along a second curve to provide a lowering movement of the carrier element.

13. The device of claim 1, wherein said carrier element is configured as one of: a mandrel, a pin, and a hook.

14. The device of claim 1, further comprising a sliding surface, configured to permit a wheel-less roll stand to slide, while moved by the carrier element and entrained by said entrainment element, the sliding surface supporting the roll stand.

15. The device of claim 1, wherein said roll stand comprises rolls configured for rolling one of rod-shaped and tubular members.

16. A method of moving a roll stand into or out of a roll stand receptacle of a rolling line, comprising:

positioning a first end of a conveying element adjacent to the roll stand receptacle and a second end of the conveying element adjacent to a roll stand changing cart;

arranging a first carrier element on the conveying element, such that the first carrier element is in contact with a first entrainment element of the roll stand while said roll stand is in said roll stand receptacle of the rolling line; and moving the first carrier element such that the carrier element follows a predetermined curved path along said conveying element and causes (i) said roll stand to move from said roll stand receptacle to said roll stand changing cart, and (ii) said roll stand to move from said roll stand changing cart to said roll stand receptacle.

17. The method of claim 16, wherein the carrier element is configured to receive the entrainment element of the roll stand.

18. The method of claim 17, further comprising:

defining in said carrier element, a recess configured to be substantially U-shaped.

19. The method of claim 16, further comprising:

coupling the entrainment element to the roll stand via an extension arm.

20. The method of claim 16, further comprising:

engaging said first carrier element and a second carrier element with said first entrainment element and a second entrainment element of the roll stand, respectively, on an operating side of the roll stand, wherein said first and second carrier elements are spaced apart from each other in a direction of the rolling line.

21. The method of claim 20, further comprising:

providing translational movement of said first and second carrier elements in a direction transverse to the direction of the rolling line, wherein said first and second carrier elements are adapted to impart movement of the roll stand via the corresponding first and second of entrainment elements of the roll stand.

22. The method of claim 21, further comprising:

moving said roll stand in a direction transverse to the rolling line, thereby separating the roll stand from a roll stand receptacle in the rolling line; and engaging a third carrier element and a fourth carrier element associated with the conveying element with a third entrainment element and a fourth entrainment element of the roll stand, respectively, said third and fourth entrainment elements of the roll stand located on a drive side of the roll stand opposite the operating side.

* * * * *